US010634300B2

(12) United States Patent
Fukui et al.

(10) Patent No.: US 10,634,300 B2
(45) Date of Patent: Apr. 28, 2020

(54) LIGHT EMITTING DEVICE

(71) Applicant: TOYODA GOSEI CO., LTD., Kiyosu-shi (JP)

(72) Inventors: Hirotaka Fukui, Kiyosu (JP); Yoshiharu Tanaka, Kiyosu (JP)

(73) Assignee: TOYODA GOSEI CO., LTD., Kiyosu-Shi, Aichi-Ken (JP)

( * ) Notice: Subject to any disclaimer, the term of this patent is extended or adjusted under 35 U.S.C. 154(b) by 0 days.

(21) Appl. No.: 16/504,707

(22) Filed: Jul. 8, 2019

(65) Prior Publication Data

US 2020/0080698 A1 Mar. 12, 2020

(30) Foreign Application Priority Data

Sep. 10, 2018 (JP) ..... 2018-168771

(51) Int. Cl.

| | |
|---|---|
| ***F21S 41/24*** | (2018.01) |
| ***F21S 45/47*** | (2018.01) |
| ***F21S 41/148*** | (2018.01) |
| ***F21S 45/50*** | (2018.01) |

(52) U.S. Cl.

CPC ..... *F21S 41/24* (2018.01); *F21S 41/148* (2018.01); *F21S 45/47* (2018.01); *F21S 45/50* (2018.01)

(58) Field of Classification Search

CPC ..... F21S 41/24; F21S 41/148; F21S 45/50; F21S 45/47; G02F 1/133606; G02F 1/133504; G02B 6/0016

See application file for complete search history.

(56) References Cited

U.S. PATENT DOCUMENTS

| | | | | |
|---|---|---|---|---|
| 9,638,389 | B2 | 5/2017 | Fukui | |
| 2014/0218951 | A1* | 8/2014 | Takada | B62J 6/02 362/511 |
| 2015/0369444 | A1 | 12/2015 | Fukui | |

FOREIGN PATENT DOCUMENTS

| | | | |
|---|---|---|---|
| JP | 2016-004755 | A | 1/2016 |

* cited by examiner

*Primary Examiner* — Joseph L Williams

*Assistant Examiner* — Jose M Diaz

(74) *Attorney, Agent, or Firm* — McGinn IP Law Group, PLLC.

(57) ABSTRACT

A light emitting device includes a light emitting element, a light guide, which includes a light guiding region and a lens region, which are continuous between both ends of the light guide, with the light guiding region to propagate therein light emitted from the light emitting element, with the lens region including a light extracting surface on an opposite side thereof to the light guiding region to extract the light propagated inside the light guiding region to outside, a first cover, which covers a surface of the light guiding region with an air layer therebetween, and a second cover, which covers the first cover while adhering tightly to a side surface of the lens region in such a manner as to hermetically seal the air layer.

12 Claims, 6 Drawing Sheets

LIGHT EMITTING DEVICE

BACKGROUND OF THE INVENTION

1. Field of the Invention

The present invention relates to a light emitting device.

2. Description of the Related Art

Conventionally, there is known a light emitting device as a linear shape light source using a rod-like light guide (see, for example, Patent Document 1). The light emitting device described in Patent Document 1 is a vehicle lamp for illuminating the exterior of a vehicle, and is assembled along an edge of a front grille on the front of the vehicle, for example.

Further, in the light emitting device described in Patent Document 1, a rod-like light guide is accommodated in an inner side of a case and a lens coupled together, and a waterproof material is installed between the case and the lens, so as to prevent the ingress of water such as rain water. The case and the lens are coupled together by engaging a claw section provided for the lens to a portion to be engaged provided for the case.

[Patent Document 1] JP-A-2016-4755

SUMMARY OF THE INVENTION

In the light emitting device described in Patent Document 1, however, since it is necessary to ensure installing regions for the claw section of the lens, the case portion to be engaged, and the waterproof material, and since it is necessary to provide a space between the case and the light guide to totally internally reflect light at the interface between the light guide and an air layer, the light emitting device is increased in width compared with the width of the light guide. This therefore makes it difficult to install the light emitting device on a member small in width.

Also, a method of welding the lens and the case is considered, but using this method requires a protecting portion having a certain width to be provided around portions to be welded so that no burr protrusion is caused by welding, for the purpose of user's safety, etc. Further, in this case, it is also necessary to provide a space between the case and the light guide in order to ensure the air layer. Furthermore, since the case and the light guide are required to be shaped so as not to bring their portions other than the portions to be welded into contact with a welding jig, their sizes may be increased to be thus shaped. This therefore also leads to an increase in the width of the light emitting device compared with the width of the light guide.

One object of the present invention is to provide a light emitting device, which is configured as a linear shape light source using a rod-like light guide, and which is waterproofed and small in width.

One aspect of the present invention provides light emitting devices defined by [1] to [5] below, to achieve the above object.

[1] A light emitting device, including: a light emitting element; a light guide, which includes a light guiding region and a lens region, which are continuous between both ends of the light guide, with the light guiding region to propagate therein light emitted from the light emitting element, with the lens region including a light extracting surface on an opposite side thereof to the light guiding region to extract the light propagated inside the light guiding region to outside; a first cover, which covers a surface of the light guiding region and a portional surface of the lens region; and a second cover, which covers the first cover while adhering tightly to a side surface of the lens region in such a manner as to hermetically seal an interface between the portional surface of the lens region and the first cover.

[2] The light emitting device according to claim 1, wherein an air layer is provided between the first cover and each of the portional surface of the lens region and the surface of the light guiding region.

[3] The light emitting device according to claim 1 or 2, wherein the first cover is made of a material including no constituent material for the light guide, while the second cover is made of a material including a constituent material for the light guide.

[4] The light emitting device according to any one of claim 1 or 2, wherein the light guiding region is circular cylindrical in shape, while the lens region is cuboid in shape, wherein the lens region is smaller in width than the light guiding region.

[5] The light emitting device according to any one of claim 1 or 2, wherein the lens region includes a linear shape protrusion, which extends in a length direction of the lens region in a region covered by the first cover on the side surface of the lens region.

[6] The light emitting device according to any one of claim 1 or 2, further including a hole and a protrusion for positioning of the light emitting element relative to the light guide, which are provided for a substrate to be mounted with the light emitting element thereon, and the light guide, respectively

[7] The light emitting device according to any one of claim 1 or 2, wherein the second cover is provided with protruding portions that are fixed to a third member.

POINTS OF THE INVENTION

According to the present invention, it is possible to provide the light emitting devices, which are configured as linear shape light sources using the rod-like light guide, and which are waterproofed and small in width.

DETAILED DESCRIPTION OF THE PREFERRED EMBODIMENTS

Embodiment (Light Emitting Device Configuration)

Figure 1:
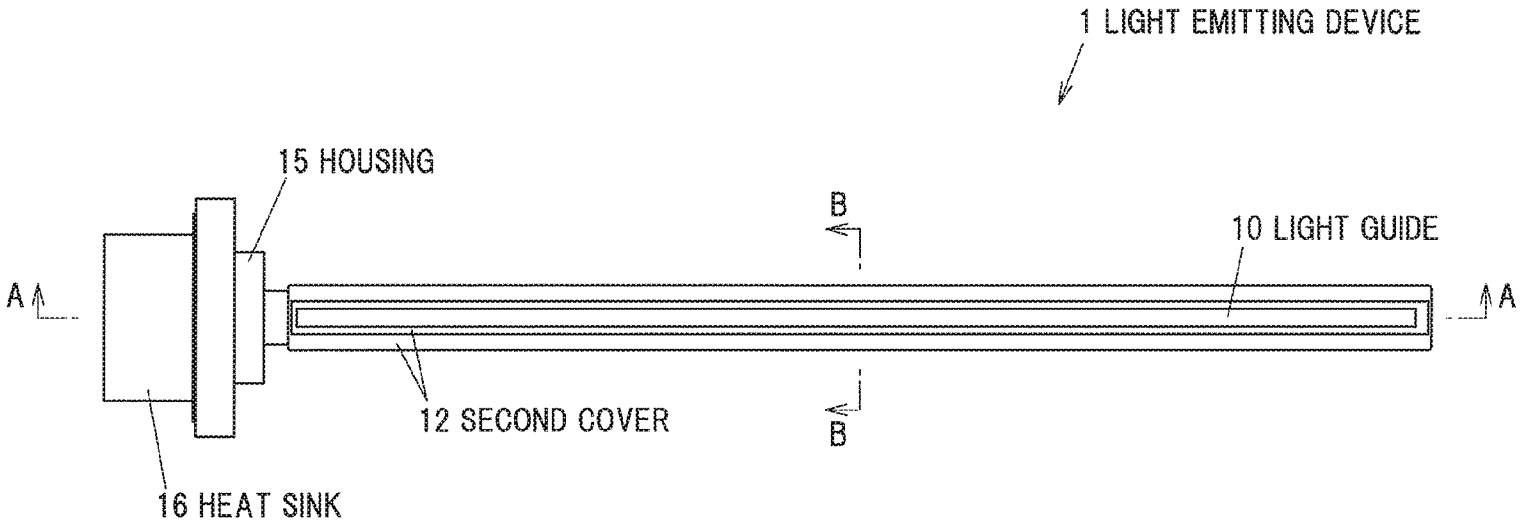
FIG. 1 is a top view of a light emitting device according to an embodiment of the present invention.
Figure 2:
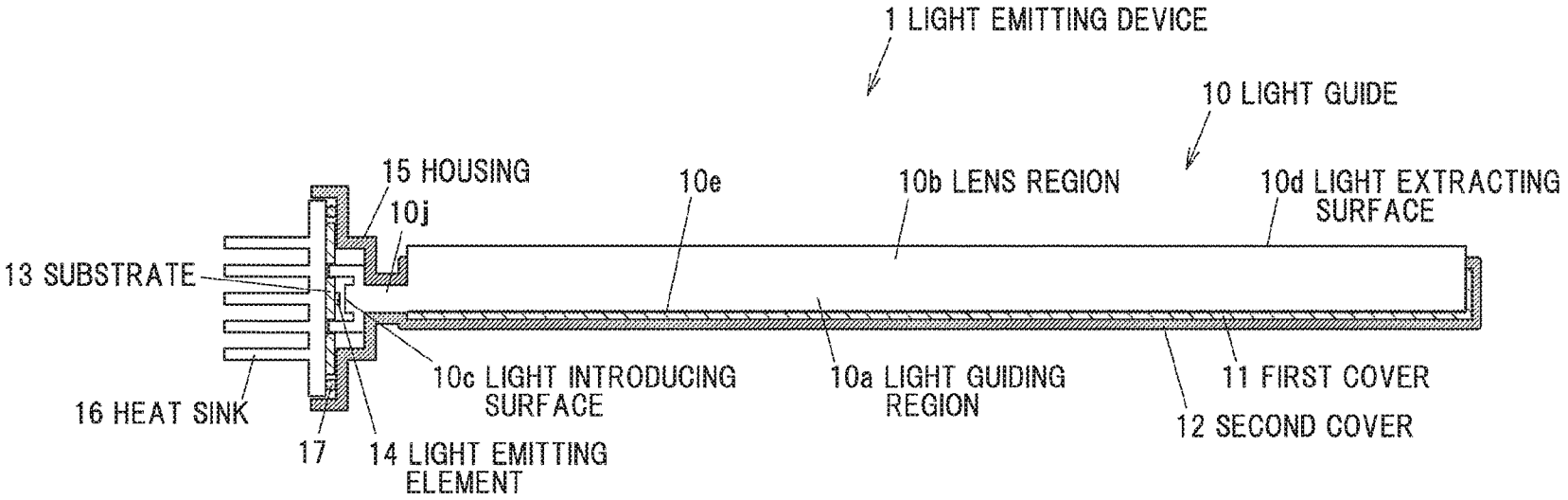
FIG. 2 is a vertical cross-sectional view of the light emitting device taken along section line A-A in FIG. 1.
Figure 3:
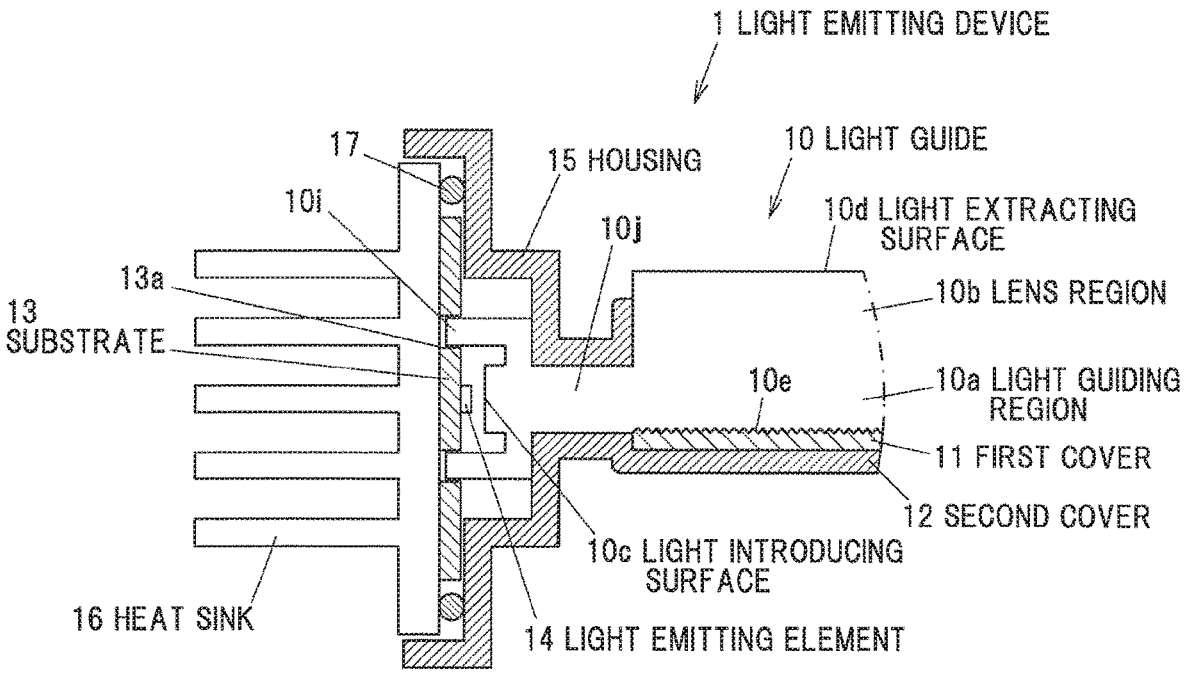
FIG. 3 is a partially enlarged vertical cross-sectional view of the light emitting device of FIG. 2.
Figure 4A:
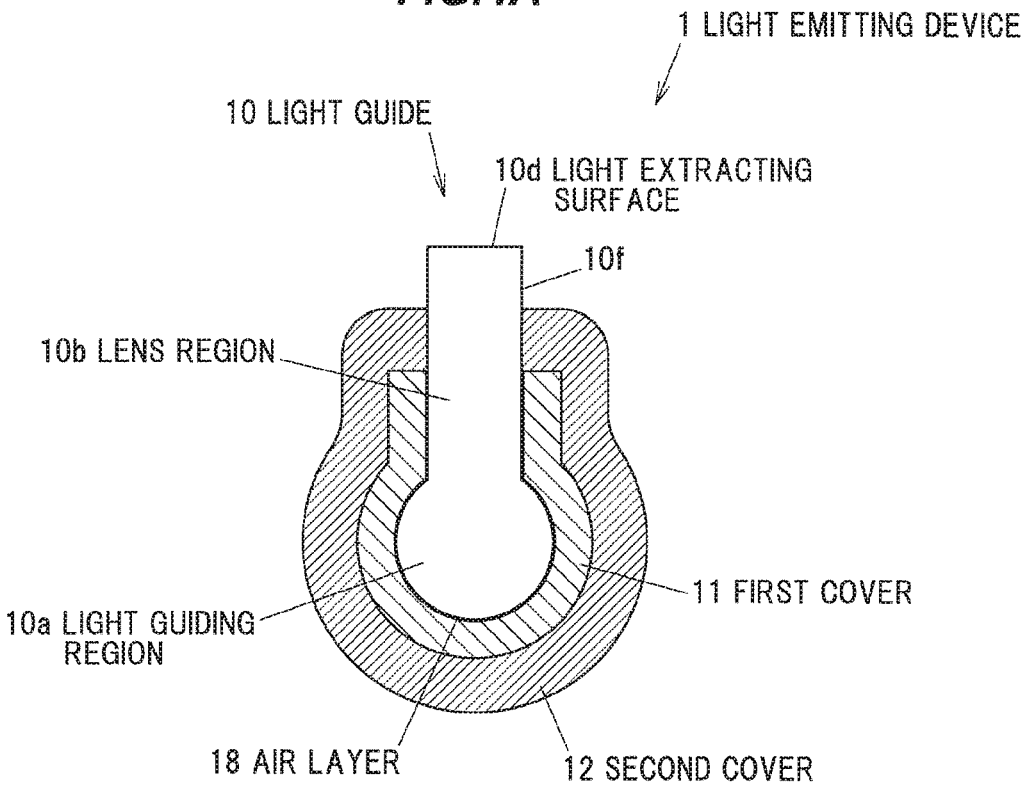
FIGS. 4A and 4B are vertical cross-sectional views of the light emitting device taken along section line B-B in FIG. 1.
Figure 4B:
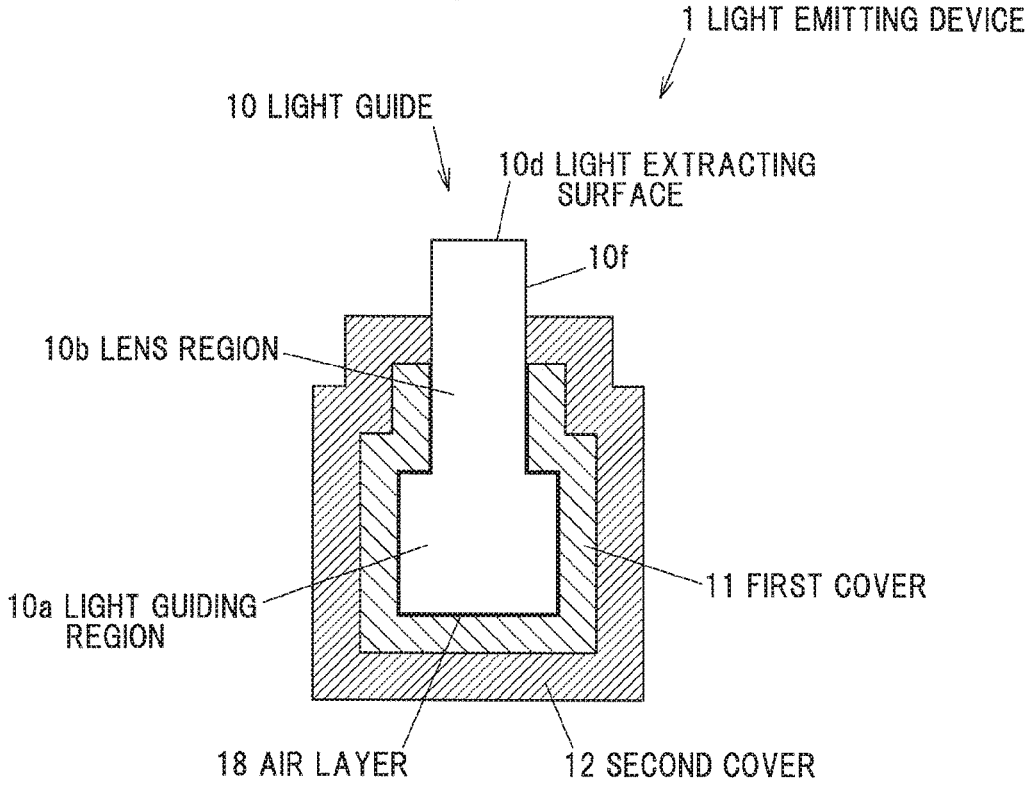

FIG. 1 is a top view of a light emitting device 1 according to an embodiment of the present invention. FIG. 2 is a vertical cross-sectional view of the light emitting device 1 taken along section line A-A in FIG. 1. FIG. 3 is a partially enlarged vertical cross-sectional view of the light emitting device of FIG. 2. FIGS. 4A and 4B are vertical cross-sectional views of the light emitting device taken along section line B-B in FIG. 1.

The light emitting device 1 is a linear shape light source capable of emitting linear shape light. Further, the light emitting device 1 has its own small width, and can therefore be attached to a member having its small width.

The light emitting device 1 includes a light emitting element 14, a rod-like light guide 10 that propagates therein light emitted from the light emitting element 14 to emit that light, a first cover 11 and a second cover 12 which cover areas other than some areas such as a light extracting surface and the like of surfaces of the light guide 10.

The light guide 10 includes a light guiding region 10*a* and a lens region 10*b*. The light guiding region 10*a* and the lens region 10*b* are continuous between both ends in a length direction of the light guide 10. That is, the shapes of the light guiding region 10*a* and the lens region 10*b* are also rod-like, or have a predetermined length, and the length directions of the light guiding region 10*a* and the lens region 10*b* match or substantially match the length direction of the light guide 10.

Note that the "rod" in the rod shape described as the shape of the light guide 10 includes not only a straight rod but also a polygonal rod or a curved rod, and the light guide 10 can be shaped according to a shape of an attachment target member to which is attached the light emitting device 1.

The light emitted from the light emitting element 14 and introduced through a light introducing surface 10*c* into the light guide 10 is passed through a region 10*j*, which connects the light introducing surface 10*c* and the light guiding region 10*a*, and the light enters the light guiding region 10*a* and propagates in the length direction of the light guiding region 10*a* inside the light guiding region 10*a*. As shown in FIG. 2, the light introducing surface 10*c* is typically provided to one end in the length direction of the light guide 10 substantially at the same height (at the same position in the vertical direction in FIG. 2) as that of the light guiding region 10*a*.

The shape of the light guiding region 10*a* is configured as a circular cylindrical shape as shown in FIG. 4A or a square cylindrical shape (e.g. a cuboid shape) as shown in FIG. 4B, for example. There is no great light guiding performance difference between total internal reflections within the circular cylinder and the square cylinder, but when the light guiding region 10*a* is circular cylindrical, all the light reflected within the light guiding region 10*a* pass across the central axis of the light guiding region 10*a*, and are therefore constant in light guiding distance, and easy to emit homogeneously. On the other hand, when the light guiding region 10*a* is square cylindrical, since not all the light reflected within the light guiding region 10*a* pass across the central axis of the light guiding region 10*a*, not all the light reflected within the light guiding region 10*a* are constant in light guiding distance, and easy to emit homogeneously. Note that regardless of whether the light guiding region 10*a* is circular cylindrical or square cylindrical, the homogeneity (uniformity ratio) of the light emission intensity distribution of the light emitting device 1 can be corrected with a plurality of steps 10*e* as described later.

The lens region 10*b* is configured to include a light extracting surface 10*d* on the opposite side thereof to the light guiding region 10*a* to extract the light propagated inside the light guiding region 10*a* to outside.

The shape of the lens region 10*b* is typically configured as a cuboid shape as shown in FIGS. 1, 2, 4A, and 4B. Note that the lens region 10*b* may be configured in a cuboid shape having a protrusion 10*g*, such as the lens region 10*b* shown in FIG. 5. The protrusion 10*g* will be described later.

Further, in order to efficiently guide the light within the light guiding region 10*a*, it is preferable that the width of the lens region 10*b* (the length in the vertical direction in FIG. 1, the length in the horizontal direction in FIGS. 4A and 4B) be smaller than the width of the light guiding region 10*a*.

The light guiding region 10*a* preferably has a plurality of steps 10*e* on the opposite side thereof to the lens region 10*b*, as shown in FIGS. 2 and 3. The plurality of steps 10*e* are continuously provided in the length direction of the light guiding region 10*a*. The steps 10*e* can reflect the light propagated within the light guiding region 10*a* toward the light extracting surface 10*d* of the lens region 10*b*. Further, by adjusting the shapes of the plurality of steps 10*e* so as to increase the light reflected off the steps 10*e* with increasing distance from the light introducing surface 10*c*, it is possible to enhance the homogeneity (uniformity ratio) of the light emission intensity distribution of the light emitting device 1.

The light guide 10 is made of a material transparent to the light emitted from the light emitting element 14, such as polycarbonate (PC), polymethyl methacrylate (PMMA), or the like.

The first cover 11 is configured to cover a surface of the light guiding region 10*a* with an air layer 18 therebetween. For this reason, the surface of the light guiding region 10*a* is being covered with the air layer 18. The first cover 11 is configured to cover the entire surface of the light guiding region 10*a*, and therefore, as shown in FIGS. 4A and 4B, it is preferable that an end portion of the first cover 11 partially cover a light guiding region 10*a* side area of a side surface 10*f* of the lens region 10*b*. Here, the side surface 10*f* refers to the surface in the length direction of the lens region 10*b* on both sides of the light extracting surface 10*d*.

The refractive index of air is 1.0, and is smaller than the refractive index of the light guide 10 (for example, about 1.6 for the light guide 10 made of PC or about 1.5 for the light guide 10 made of PMMA), so by totally internally reflecting the light at the interface between the light guide and the air layer 18, it is possible to suppress the attenuation of the light being propagated within the light guiding region 10*a*. In addition, since the refractive index of the air is smaller than the refractive index of the first cover 11 (for example, about 1.5 for the first cover 11 made of polypropylene (PP)), the critical angle is smaller and the total internal reflection is more likely to occur than when the first cover 11 has its refractive index greatly different from the refractive index of the light guide 10, and is being adhered to the light guide 10. This makes it possible to suppress a lowering in the light emission intensity in a region separate from the light introducing surface 10*c*.

The first cover 11 can be formed by using a material having poor adhesiveness to the light guide 10, and by insert molding or two-color molding with the light guide 10 to serve as a base member. According to this method, since the light guide 10 and the first cover 11 are not adhered to each other, there is naturally formed a space, in other words, the air layer 18 between the light guide 10 and the first cover 11.

The material having poor adhesiveness to the light guide 10 is configured as, for example, a material including no constituent material for the light guide 10. For example, when the light guide 10 is made of PC or PMMA, it is preferable to use polypropylene (PP) as the material for the first cover 11 from the viewpoint of poorness of adhesiveness, and cost.

In order to efficiently reflect the light not reflected at the interface between the light guide 10 and the air layer 18, it is preferable that the first cover 11 is configured as a white member containing a white dye such as titanium oxide. Note that when it is desirable to avoid seeing the white color when the light emitting device 1 is not lighted, the first cover 11 may be made of a black member containing a black dye such as carbon black.

The second cover 12 is configured to cover the first cover 11 while adhering tightly to the side surface 10*f* of the lens region 10*b* in such a manner as to hermetically seal the air layer 18 between the light guide 10 and the first cover 11. That is, an end portion of the second cover 12 is closer to the light extracting surface 10*d* than the end portion of the first cover 11, and the second cover 12 is adhered tightly to the side surface 10*f* in its end portion.

By using the second cover 12 to hermetically seal the air layer 18 between the light guide 10 and the first cover 11, it is possible to prevent the ingress of water into the air layer 18. Since water is higher in refractive index than air, the occurrence of the ingress of water into the air layer 18 renders the total internal reflection difficult, leading to an increase in the attenuation of the light being propagated within the light guiding region 10*a*.

The second cover 12 can be formed by using a material having good adhesiveness to the light guide 10, and by insert molding with the light guide 10 covered by the first cover 11 to serve as a base member. According to this method, since the light guide 10 and the second cover 12 are adhered tightly to each other, the air layer 18 between the light guide 10 and the first cover 11 is hermetically sealed, to be able to ensure the waterproofness.

The material having good adhesiveness to the light guide 10 is configured as, for example, a material including the constituent material for the light guide 10. For example, when the light guide 10 is made of PC, it is possible to use, as the material for the second cover 12, PC, or PC+AES (a mixture of PC and acrylonitrile ethylene-propylene-diene styrene (AES)), or PC+ASA (a mixture of PC and acrylonitrile styrene acrylate (ASA)). The mixtures PC+AES and PC+ASA are particularly preferable as the material for the second cover 12 because they are excellent in light resistance. When the light guide 10 is made of PMMA, PMMA can be used as the material for the second cover 12.

In order to prevent light leakage, the second cover 12 is configured preferably as a white member containing a white dye such as titanium oxide or a black member containing a black dye such as carbon black, and more preferably as a black member.

The light guiding region 10*a* of the light guide 10 is not exposed to outside by being covered by the first cover 11 and the second cover 12. A light guiding region 10*a* side area of the side surface 10*f* of the lens region 10*b* is at least partially covered by the first cover 11 and the second cover 12.

Figure 5:
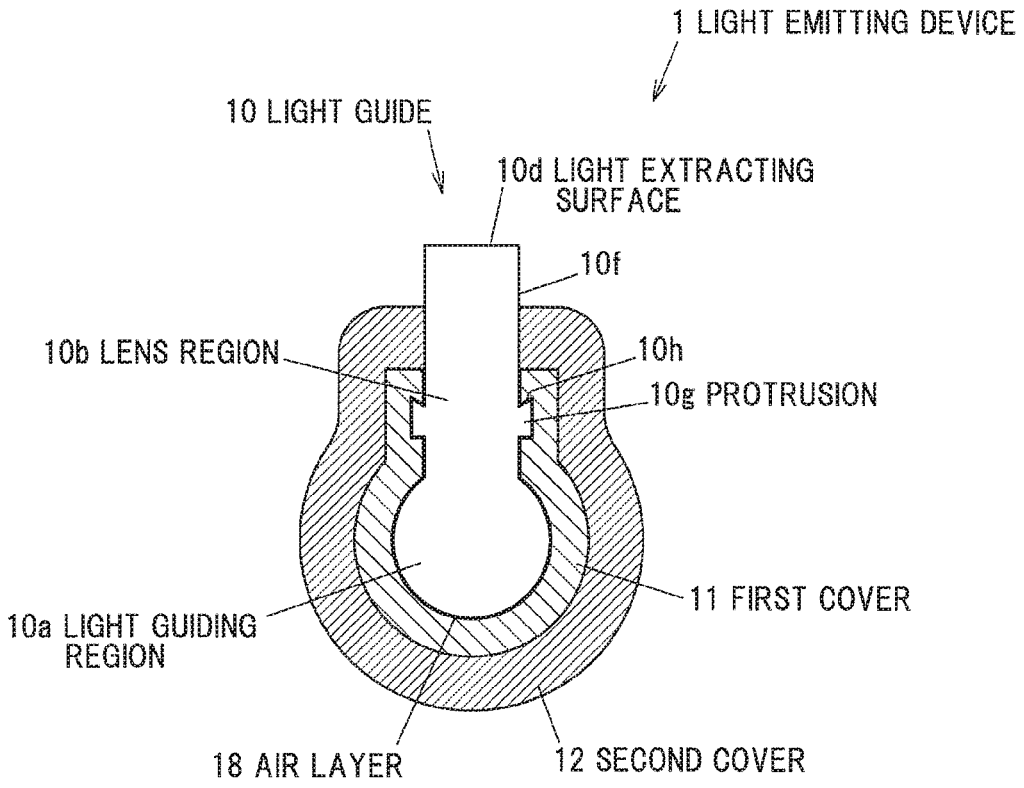
FIG. 5 is a vertical sectional view of a modification to the light emitting device according to the embodiment of the present invention.

FIG. 5 is a vertical sectional view of a modification to the light emitting device 1. As shown in FIG. 5, the lens region 10*b* of the light guide 10 may have a protrusion 10*g* in a region covered by the first cover 11 of the side surface 10*f*. The protrusion 10*g* is configured as a linear shape protrusion extended in the length direction of the lens region 10*b*. In addition, it is preferable that the protrusion 10*g* is also formed on an end face in the length direction of the lens region 10*b*.

Since the light guide 10 and the first cover 11 are not adhered to each other, when the second cover 12 is molded, the resin injected into a die may enter the space (the air layer 18) between the light guide 10 and the first cover 11. When the resin having entered that space reaches the surface of the light guiding region 10*a*, the total internal reflection does not or is difficult to occur at the interface between that resin and the light guiding region 10*a*, therefore leading to an increase in the attenuation of the light being propagated within the light guiding region 10*a*.

By providing the protrusion 10*g*, it is possible to extend and deflect the ingress path of the resin to prevent the ingress of the resin. In particular, as shown in FIG. 5, by making acute the angle between a first cover 11 end portion side (a resin ingress side) surface 10*h* of the protrusion 10*g* and the side surface 10*f* of the lens region 10*b*, the ingress path of the resin is more difficult to enter, and by fixing the first cover 11 to the lens region 10*b* to make small the space between the first cover 11 and the lens region 10*b*, it is possible to suppress the ingress of the resin.

Used as the light emitting element 14 is typically an LED. The LED is a small-sized light emitting element, and is low in power consumption and in amount of heat generation, and long in life, and therefore suitable for use as the light emitting element 14. Note that the light emitting elements 14 may be installed at both the ends in the length direction of the light guide 10. In that case, the light introducing surfaces 10*c* are provided at both the ends in the length direction of the light guide 10.

The light emitting element 14 is mounted on a substrate 13. The substrate 13 is configured as a wiring substrate having a wiring to be connected to electrodes of the light emitting element 14.

The substrate 13 has a positioning hole 13*a*. A protrusion 10*i* which is configured as a part of the light guide 10 is inserted into the hole 13*a*, to determine the position of the substrate 13 with respect to the light guide 10, that is, the position of the light emitting element 14 with respect to the light guide 10. The positioning of the light emitting element 14 with respect to the light guide 10 is important for efficiently guiding the light emitted from the light emitting element 14 into the light guide 10.

Note that the protrusion 10*i* for the positioning of the substrate 13 may be provided as a part of (a housing 15 which is configured as a part of) the second cover 12, but since as mentioned above, the position of the light emitting element 14 with respect to the light guide 10 is important, it is preferable that the protrusion 10*i* be configured as a part of the light guide 10.

The housing 15 which accommodates the light emitting element 14 is configured as a part of the second cover 12 to prevent light leakage to outside.

A heat sink 16 is configured as a heat dissipating member to dissipate heat radiated from the light emitting element 14, and is fixed to the housing 15. The substrate 13 is fixed to the heat sink 16 directly or with another layer therebetween.

Further, the space within the housing 15 is preferably hermetically sealed by an annular sealing member 17, which is installed between the housing 15 and the heat sink 16. The sealing member 17 is configured as, for example, an O-ring or a packing, and the sealing member 17 fulfills its sealing function by being sandwiched between the housing 15 and the heat sink 16 and moderately compressed.

Figure 6A:
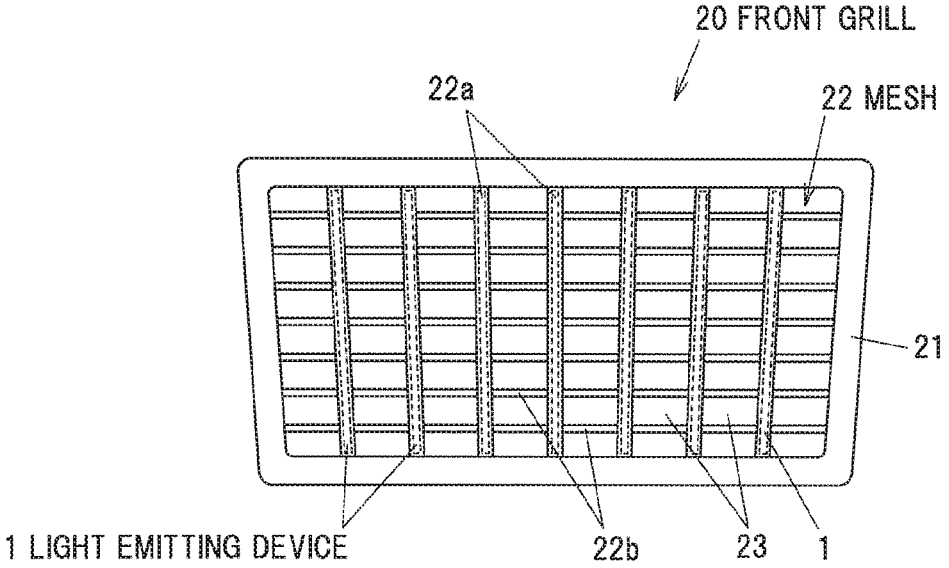
FIG. 6A is a schematic view of a front grille of a vehicle, which is one example of a member (design member) to which is attached the light emitting device according to the embodiment.
Figure 6B:
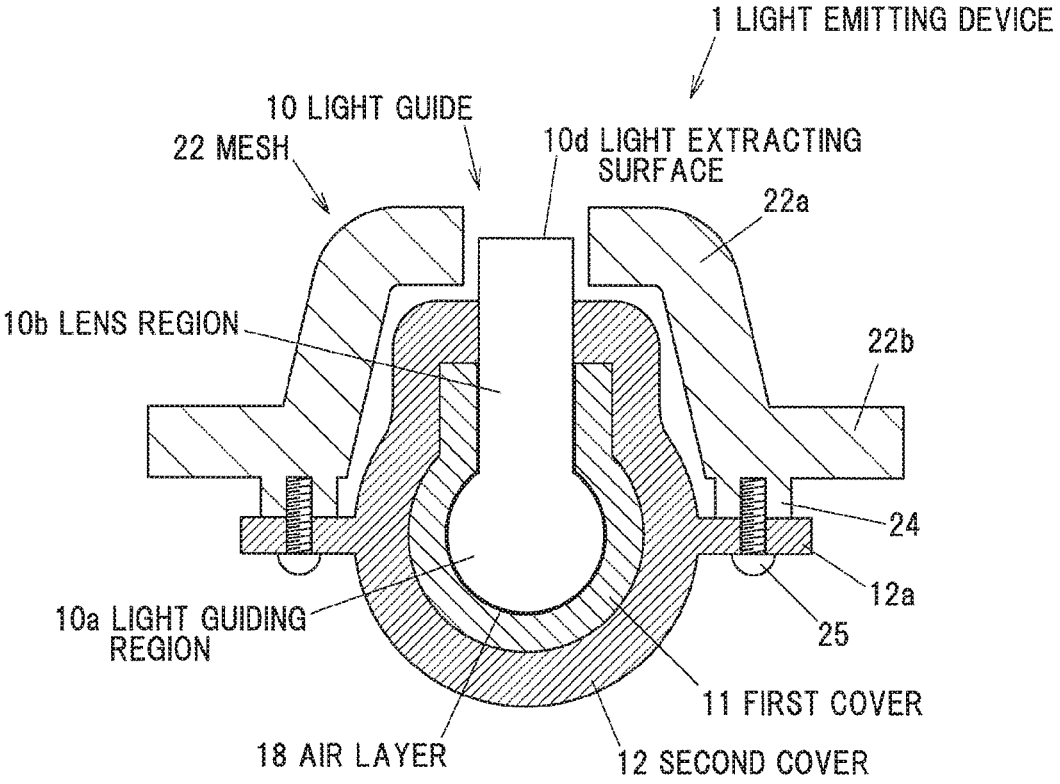
FIG. 6B is a cross-sectional view of the light emitting device installed on the front grille.

FIG. 6A is a schematic view of a front grill 20 of a vehicle, which is one example of a member (design member) to which the light emitting device 1 is attached. FIG. 6B is a cross-sectional view of the light emitting device 1 installed on the front grille 20.

The front grille 20 has a frame 21, and a mesh 22 installed within the frame. Openings of the mesh 22 acts as intakes to take air into an engine or a radiator of the vehicle.

In the example shown in FIG. 6A, the mesh 22 is composed of linear portions 22*a*, which extend in the vertical direction, and linear portions 22*b*, which extend in the horizontal direction, and the light emitting devices 1 are installed in the linear portions 22*a*. In FIG. 6A, the example of the installation positions of the light-emitting devices 1 are schematically indicated by dotted line.

The light emitting device 1 is installed on the back side of the linear portions 22*a* of the mesh 22, and the light extracting surfaces 10*d* of the light emitting devices 1 are exposed from linear openings provided in the linear portions 22*a*. This allows the linear portions 22*a* to linearly emit light.

When the light emitting devices 1 are installed on the front grille 20, since the widths of the light emitting devices 1 are small, the light emitting devices 1 are not protruded from the linear portions 22*a* and so appearance is not impaired. In addition, since the opening area of the mesh 22 is not narrowed, the intake function of the front grille is not reduced.

For example, as shown in FIG. 6B, the light emitting devices 1 are fixed by being screwed to the intersections of the linear portions 22*a* and the linear portions 22*b* of the mesh 22. Specifically, screw fixing portions 24, which are provided on the back side of the intersections of the linear portions 22*a* and the linear portions 22*b* of the mesh 22, and screwing protruding portions 12*a*, which are configured as part of the second cover 12, are fixed with screws 25.

In the embodiment described above, the air layer 18 may be omitted, if the first cover 11 and the light guiding region 10*a* are not adhered to each other.

Since the light emitting device 1 is excellent in waterproofness, it can be installed on an area where water adheres, such as an exterior part of a vehicle. Examples of the installation area in the vehicle include, besides the front grille, design members such as a plating mall and a garnish, a space between the garnish and the body, and the like.

Advantageous Effects of the Embodiments

According to the light emitting devices 1 of the above embodiments, it is possible to thinly and easily form the air layer 18 covering the rod-like light guide 10 with the first cover 11, and it is possible to ensure the waterproofness with the second cover 12. This makes it possible to provide the light emitting devices, which are configured as linear shape light sources using the rod-like light guide, and which are waterproofed and small in width.

The light emitting device 1 composed of the light guide 10, the first cover 11, and the second cover 12 can be small in width as compared to the conventional light emitting device with a light guide accommodated in an inner side of a lens and a case, and can be installed even on a member small in width without impairing its functions and its appearance.

Although the embodiments of the present invention have been described above, this invention is not limited to the above-described embodiments, but various modifications can be implemented without deviating from the spirit of the invention. Further, the embodiments described above are not to be construed as limiting the inventions according to the claims. It should also be noted that not all combinations of the features described in the embodiments are indispensable to the means for solving the problem of the invention.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

DESCRIPTIONS OF THE REFERENCE CHARACTERS

1 Light emitting device
10 Light guide
10*a* Light guiding region
10*b* Lens region
10*c* Light introducing surface
10*d* Light extracting surface
10*f* Side surface
10*g* Protrusion
10*i* Protrusion
13 Substrate
13*a* Hole

What is claimed is:

1. A light emitting device, including:

a light emitting element;

a light guide, which includes a light guiding region and a lens region, which are continuous between both ends of the light guide, with the light guiding region to propagate therein light emitted from the light emitting element, with the lens region including a light extracting surface on an opposite side thereof to the light guiding region to extract the light propagated inside the light guiding region to outside;

a first cover, which covers a surface of the light guiding region and a portional surface of the lens region; and a second cover, which covers the first cover while adhering tightly to a side surface of the lens region in such a manner as to hermetically seal an interface between the portional surface of the lens region and the first cover.

2. The light emitting device according to claim 1, wherein an air layer is provided between the first cover and each of the portional surface of the lens region and the surface of the light guiding region.

3. The light emitting device according to claim 1, wherein the first cover is made of a material including no constituent material for the light guide, while the second cover is made of a material including a constituent material for the light guide.

4. The light emitting device according to claim 1, wherein the light guiding region is circular cylindrical in shape, while the lens region is cuboid in shape, wherein the lens region is smaller in width than the light guiding region.

5. The light emitting device according to claim 1, wherein the lens region includes a linear shape protrusion, which extends in a length direction of the lens region in a region covered by the first cover on the side surface of the lens region.

6. The light emitting device according to claim 1, further including a hole and a protrusion for positioning of the light emitting element relative to the light guide, which are provided for a substrate to be mounted with the light emitting element thereon, and the light guide, respectively.

7. The light emitting device according to claim 1, wherein the second cover is provided with protruding portions that are fixed to a third member.

8. The light emitting device according to claim 2, wherein the first cover is made of a material including no constituent material for the light guide, while the second cover is made of a material including a constituent material for the light guide.

9. The light emitting device according to claim 2, wherein the light guiding region is circular cylindrical in shape, while the lens region is cuboid in shape, wherein the lens region is smaller in width than the light guiding region.

10. The light emitting device according to claim 2, wherein the lens region includes a linear shape protrusion, which extends in a length direction of the lens region in a region covered by the first cover on the side surface of the lens region.

11. The light emitting device according to claim 2, further including a hole and a protrusion for positioning of the light emitting element relative to the light guide, which are provided for a substrate to be mounted with the light emitting element thereon, and the light guide, respectively.

12. The light emitting device according to claim 2, wherein the second cover is provided with protruding portions that are fixed to a third member.

* * * * *